United States Patent [19]

Wilson

[11] 4,336,974

[45] Jun. 29, 1982

[54] COAXIAL ROTARY JOINT

[75] Inventor: Ronald A. Wilson, Medway, Mass.

[73] Assignee: Microwave Development Labs. Inc., Needham, Mass.

[21] Appl. No.: 121,269

[22] Filed: Feb. 13, 1980

Related U.S. Application Data

[63] Continuation-in-part of Ser. No. 959,863, Nov. 13, 1978, abandoned.

[51] Int. Cl.[3] ..... H01R 5/02

[52] U.S. Cl. ..... 339/8 R; 339/278 C; 339/177 R

[58] Field of Search ..... 339/5, 6, 8, 118 RY, 339/177, 278 C

[56] References Cited

U.S. PATENT DOCUMENTS

| | | | |
|---|---|---|---|
| 1,904,241 | 4/1933 | Kammerer | 339/278 C |
| 2,343,306 | 3/1944 | Lear | 339/5 P |
| 2,967,216 | 1/1961 | Zablocki et al. | 339/5 P |
| 3,408,610 | 10/1968 | Clarkson | 339/8 R |
| 3,786,376 | 1/1974 | Munson et al. | 339/8 PB |
| 4,138,604 | 2/1979 | Harmsen et al. | 339/278 C |

FOREIGN PATENT DOCUMENTS

| | | | |
|---|---|---|---|
| 458723 | 8/1949 | Canada | 339/6 A |

*Primary Examiner*—Joseph H. McGlynn
*Attorney, Agent, or Firm*—Wolf, Greenfield & Sacks

[57] ABSTRACT

An improved rotary joint which is embodied, in a preferred version, in an electrical coaxial rotary connector having relatively rotatable male and female housings defining an outer conductor and means defining an inner conductor. One of the housings carries silver-graphite contacts including an outer annular contact associated with the outer conductor and a centrally disposed disc-like contact associated with the inner conductor. Contact between the contacts of the one housing and conductor points on the other housing is provided by a relatively simple contact means in the form of a first centrally disposed bowed spring washer associated with the disc-like contact and an annular spring washer having a plurality of crest contact locations (waves) associated with the outer annular contact. The spring washers are both constructed of a hard conductor material such as berylium copper plated with, for example, silver and then with a tarnish resisting layer such as rhodium or gold. The wave contact causes the plating to wear but only at the crest contact locations maintaining partial conductivity directly between the remaining silver plate and silver-graphite contact.

22 Claims, 6 Drawing Figures

COAXIAL ROTARY JOINT

RELATED APPLICATION

This is a continuation-in-part of application Ser. No. 959,863 filed Nov. 13, 1978, now abandoned.

BACKGROUND OF THE INVENTION

The present invention relates in general to a coaxial rotary joint. In accordance with the invention there is disclosed herein an electric coaxial rotary connector having relatively rotatable male and female housings defining an outer conductor and including means also defining an inner conductor. In the embodiment described hereinafter the invention is taught in connection with the known type N coaxial connector. However, it is understood that the principles of the invention may be applied to any types of connectors, even those carrying only a single conductor.

The present coaxial rotary joint is a relatively complex device requiring inner and outer spring finger contacts and separate biasing springs for the contacts associated with one of the housings forming the connector. There are several components in the prior art joint that make the construction quite expensive. The spring finger contacts require a separate slotting operation and heat treating during manufacture thus making for a much more expensive part in comparison to a standard screw machine part. Also, in order to provide enough area for spring contact and proper finger contact operation, the contacts which may be silver-graphite contacts have to be relatively large. Because these contacts are quite expensive, this also increases the cost of the overall device. The other contacts may be coin silver contacts. These contacts are also expensive but in the existing designs are required due to contact noise requirements. Also, in existing devices, leaf-type contacts are required to allow some compliance at the contact interface with the silver-graphite contact to control contact pressure in the event of wear and temperature variations.

Accordingly, one object of the present invention is to provide an improved rotary electrical connector, preferably a coaxial rotary joint that is of improved design in comparison with existing connectors of that type.

Another object of the present invention is to provide an improved rotary electrical connector that is of simplified construction, that does not require any unusual fabrication techniques, and that can be manufactured relatively inexpensively.

A further object of the present invention is to provide an improved rotary electrical connector that, albeit of simplified construction, has excellent contact noise parameters.

BRIEF SUMMARY OF THE INVENTION

To accomplish the foregoing and other objects of this invention there is provided in the disclosed embodiment, a rotary electrical connector comprised of a pair of members or housings each having at least one conductive contact supported thereby. Means are provided intercoupling the first and second members in fixed axial relationship but permitting relative rotation between these members. In the disclosed embodiment the electrical connector is a coaxial connector and thus each of the members include a center conductor and an outer conductor. At the interface between the conductors of respective members, an intermediate resilient means is provided preferably in the form of a bowed surface disc for contacting a flat surface of one of the conductive contacts. This means is constructed preferably of a relatively hard, wear-resistant conductive metal having means permitting at least slight compression thereof in a direction axially of the connector. This metal is preferably selected from one of the elements of the noble family. After a period of wear-in, there is provided primary bearing contact at the wear-resistant metal and at the same time conductive contacts thereabout between the conductive contact in the remaining unworn noble metal.

In accordance with one embodiment of the invention the resilient means may be in the form of a biasing means or spring which is constructed from berylium copper plated with a silver plating. The spring is then preferably also provided with a tarnish resisting layer of, for example, rhodium or gold plated over the silver. In this example, as the spring wears, the silver outer layer wears away exposing the berylium copper substrate which is very resistant to wear thus slowing down the wear rate to substantially negligible amounts. However, at the edges of the surface, silver is still exposed to provide low noise contact.

In accordance with another embodiment of the present invention the spring washers, instead of being provided with a silver plating on a substrate, may be totally constructed of a coin silver such as Consil 901 made by Handy & Harman of New York, New York. The coin silver is a silver-copper alloy which has a higher resistance to wear than fine silver. The only possible drawback to this embodiment is that the cost of the solid coin silver spring washer may be greater than the cost of the composite washer.

In accordance with still another embodiment described herein, there may be inserted between the wave washer and one of the conductive contacts, a further washer that may be a coin silver washer so that relative rotation occurs between the coin silver washer and the conductive contact. In this embodiment the coin silver washer may be pinned to the wave washer.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
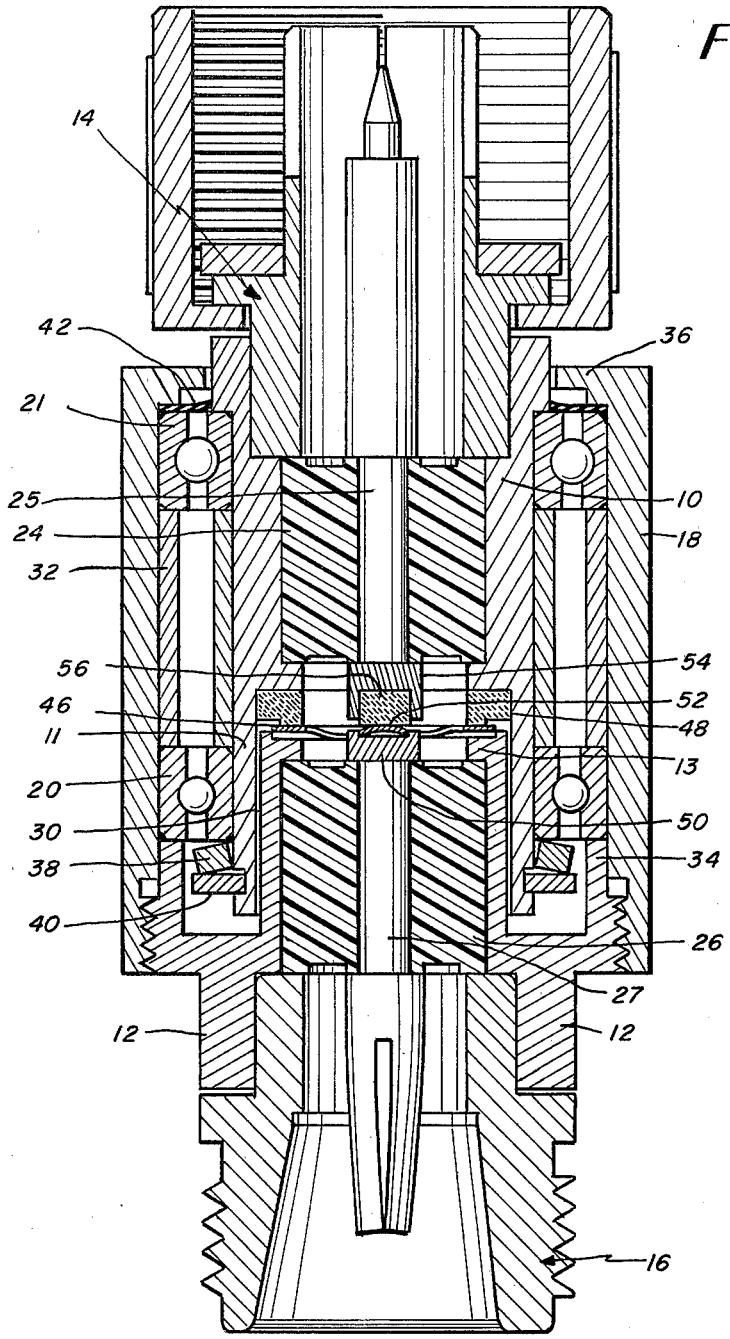
FIG. 1 is a cross-sectional longitudinal view taken through a coaxial connector constructed in accordance with the principles of this invention.
Figure 5:
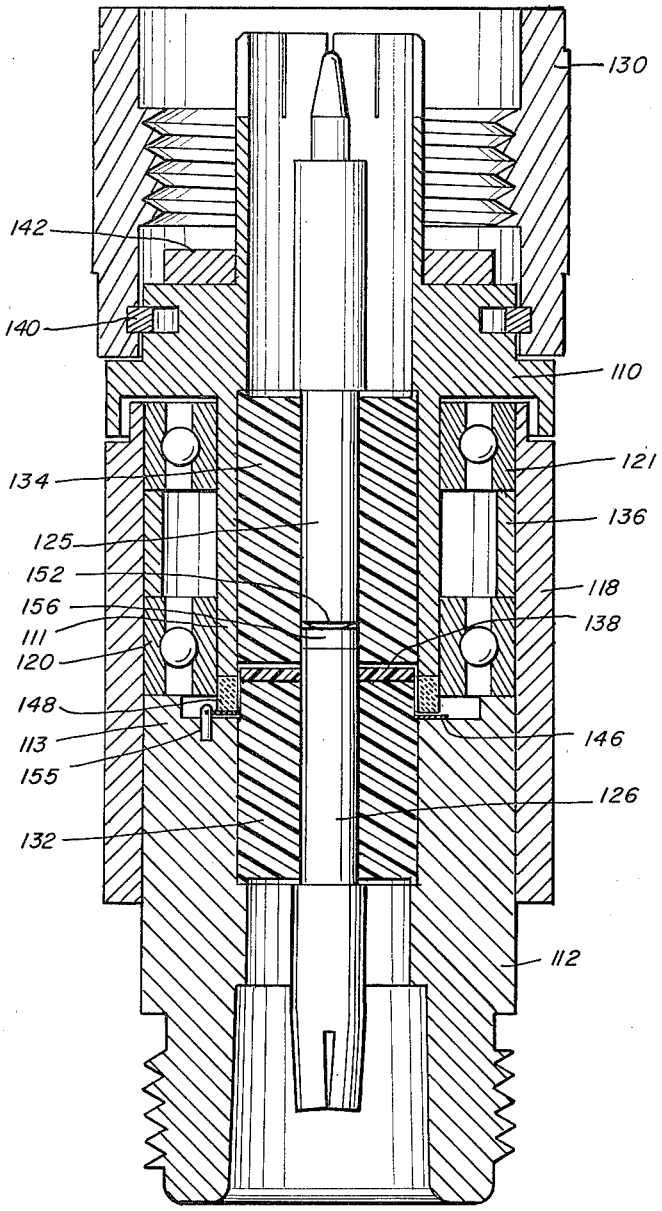
FIG. 5 is a cross-sectional longitudinal view of an alternate preferred embodiment of the present invention.
Figure 6:
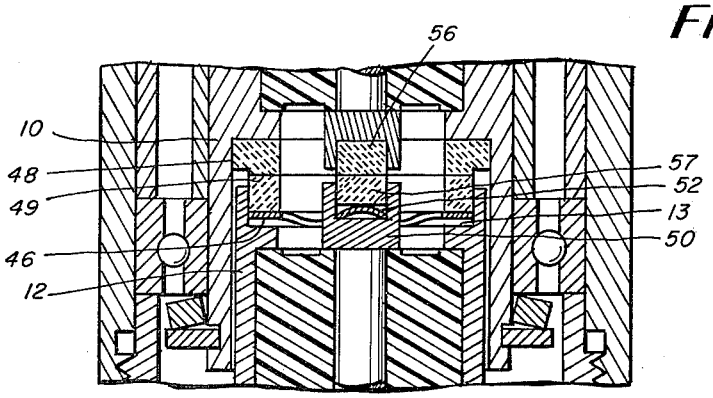
FIG. 6 is a fragmentary cross-sectional view through a connector showing still another embodiment of the present invention.

FIG. 1 shows one embodiment of a connector employing the principles of this invention and in the form of a coaxial rotary joint or connector. FIG. 5 shows a preferred construction of a connector. FIG. 6 shows still another embodiment employing an additional component. It is understood that the principles of this invention may be applied in constructing many different types of rotary electrical connectors. In FIG. 1, the connector comprises housings 10 and 12 which are relatively rotatable, male connector member 14, female connector member 16, locking sleeve 18, and bearings 20 and 21. The housings 10 and 12 are constructed of a metal and essentially form the outer conductor of the coaxial connector. The male connector member 14 is press-fitted into the outer end of the housing 10 capturing in the housing the insulator block 24. Similarly, the female member 16 is press-fitted into the outer end of the housing 12 capturing the insulator block 26. The insulator blocks 24 and 26 encase the center conductors 25 and 27, respectively. The members 14 and 16 may be of conventional design and of the typical type used with a type N connector.

As previously mentioned, there is, of course, relative rotation between the housings 10 and 12. This relative rotation is primarily along a clearance gap 30. The relative rotation is by means of the bearings 20 and 21 which are basically supported between housing 10 and the outer locking sleeve 18. A spacer 32 is preferably provided for spacedly disposing the bearings 20 and 21. The bearing 21 also is urged against a flange 34 of the housing 12 while the bearing 21 is retained by means of an end flange 36 on the locking sleeve 18. A pressure washer 38 is retained by snap-ring 40 to position the bearings 20 and 21 on their inner race. Preferably also a seal 42 is provided intermediate the flange 36 and the bearing 21. It is primarily the operation of the locking sleeve 18 relative to the housing 12 that provides means for retaining the bearings in a fixed position essentially holding the outer race of these bearings fixed relative to the locking sleeve 18 and the housing 12.

Figure 2:
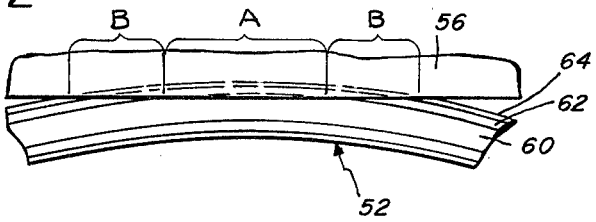
FIG. 2 is an enlarged fragmentary view of a portion of the connector of FIG. 1 taken in the area of contact between the spring washers and the silver graphite contact.
Figure 4:
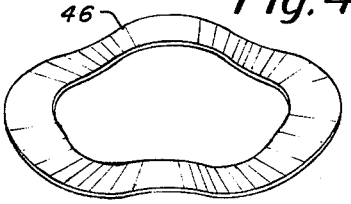
FIG. 4 is a perspective view showing the wave washer.

At the end 13 of the housing 12 there is provided an annular recess for receving the wave washer 46. The other housing 10 also has an end 11 defining a cavity for receiving an annular silver-graphite contact 48. The contact 48 is suitably secured in the end 11 possibly with the use of adhesives or a press fitting. FIG. 4 shows a perspective view of the wave washer 46 and FIG. 2 shows a fragmentary view of a portion of the washer 46 which actually functions as a wave-type spring. Specific characteristics regarding the wave spring 46 are discussed hereinafter.

Figure 3:
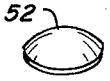
FIG. 3 is a perspective view showing the bowed washer.

The housing 12 at the end of the center conductor 27 also supports a center contact 50 that is recessed to accommodate the stamped spring bow washer 52. Similarly, the end of the center conductor 25 associated with housing 10 supports a member 54 which is metallic and a conductor and which in turn supports a center silver-graphite contact 56. The contact 56 may be supported in the same way as contact 48. Preferably, both of these contacts have flat surfaces for contact with the springs 46 and 52. FIG. 3 depicts a perspective view of the centrally disposed bowed spring 52.

FIG. 2 is an enlarged fragmentary view of a segment of the concave, bowed spring washer 52 as it cooperates with the silver-graphite contact 56 that rotates relative thereto. FIG. 2 depicts the interaction between these members after a predetermined period of wear-in. FIG. 2 also shows in dotted the initial shape and composition of the spring washer 52.

As previously mentioned, the contact 56 may be constructed of a silver-graphite. The contact 50 associated with housing 12 may be constructed of a metal such as aluminum or steel. The washers 52 and 46 in a preferred embodiment are constructed from berylium-copper sheet material heat-treated in a fixture to provide a smooth radius curvature to thus form a precision wave washer spring forming the outer conductor washer 46, and a small disc bowed with a smooth curvature to function as the center conductor contact. In the preferred version after the heat-treating the contact springs are silver-plated to provide a low noise running contact. Thereafter, a tarnish resisting layer is preferably provided of, for example, rhodium or gold plated over the silver. FIG. 2 shows the berylium copper substrate 60, the silver-plating 62, and the outer tarnish resisting layer 64. As the spring wears, the silver is worn away along with the tarnish resisting layer to expose the berylium copper substrate along the area A depicted in FIG. 2. Because this substrate is highly resistant to wear, the wear rate immediately slows down to a virtually negligible amount of wear. However, at the edge areas B the silver-plating is still in contact and exposed to the silver-graphite contact 56 to thus provide a low noise contact. It is thus the combination of direct contact with the berylium copper providing a very high resistant wearing surface along with the contact with the silver-plating that provides the low noise parameter for the connector.

In an alternate embodiment of the invention another metal from the noble family may be substituted for the silver-plating used on the springs. There, for example, gold or copper could be used although copper is not as desirable because of oxides of copper that may form providing high resistance problems. Silver is preferred also because it is harder than gold and generally cheaper. Also, the substrate, although in this disclosed embodiment is berylium copper, may also be constructed of other elements or alloys that have the characteristic of being relatively hard and substantially wear-resistant along with being a conductor. For example, one could use a nickel foil or any other hard conductive metal. With regard to the substrate, it is important that, in addition to having good wear characteristics, that it also have good spring properties which generally means that the substrate must be of a hard material, and furthermore is of a type having a good electrical conductivity.

In accordance with the invention, in an alternate embodiment, employing the improved biasing contact means, instead of using a silver plating or the like on a substrate, the entire member may be constructed of a coin silver such as Consil 901 made by Handy & Harman of New York, N.Y. This coin silver is a silver-copper alloy. It is quite hard and has an improved resistance to wear in comparison with fine silver. This alloy typically includes 90% silver and 10% copper. In addition there may be small other impurities in the alloy of, for example, lead or cadmium. With the entire member being constructed of this coin silver there is then provided good electrical conductivity, low noise, and good wear characteristics.

FIG. 5 is a cross-sectional view of a preferred embodiment of the rotary connector, including many components similar to those disclosed in FIG. 1. This embodiment is also a type N coaxial rotary connector. In FIG. 5 the connector comprises housing 110 and 112, coaxial rotary joint body 118, coupling nut 130, and bearings 120 and 121. The housings 110 and 112 are constructed of a metal and essentially form the outer conductor of the coaxial connector. The housing 112 is press fitted into one end of the body 118. The coupling nut 130 is secured to the other housing 110 by means of the coupling nut lock ring 140. Within the housing 110, there is disposed the bead support 134 disposed about the female center conductor 125. Similarly, within the housing 112 there is provided the bead support 132 disposed about the female center conductor 126.

As previously mentioned, there is relative rotation between the housings 110 and 112. The relative rotation is possible by means of the bearings 120 and 121 which are basically supported between the housing 110 and the body 118. A spacer 136 is preferably provided for spacedly disposing the bearings 120 and 121. Both of the bearings 120 and 121 along with the spacer 136 may be forcibly fit inside the body 118.

At the end 113 of the housing 112 there is provided an annular recess for receiving the wave washer 146. The other housing 110 also has an end 111 for receiving an annular silver-graphite contact 148. The contact 148 is suitably secured at the end 111 perhaps with the use of an adhesive. The wave washer 146 may be of the same construction and configuration as the wave washer 46 previously described in connection with the first embodiment and shown in a perspective view in FIG. 4. The specific characteristics of the wave washer or spring 146 may be previously described with the washer 46.

The center conductor 125 has means for supporting the stamped spring bow washer 152 which also may be of substantially the same construction as described previously with regard to the washer 52 shown in FIG. 1. There may be provided in this embodiment a construction similar to the one shown in FIG. 1 including the member 50 for supporting the washer 152. The end of the center conductor 126 supports a center silver-graphite contact 156. The relative rotation occurs primarily between this contact 156 and the washer 152.

In the embodiment of FIG. 5, there are provided bead supports 132 and 134 having disposed therebetween a matching bead 138. There is a gap provided between the beads 134 and 138 that could possibly create a mismatch and, thus, there is provided the mismatch bead 138 which has a different dielectric constant than the beads 132 and 134. The mismatch bead 138 has a higher dielectric constant than the beads 132 and 134. In an arrangement such as depicted in FIG. 1 there may be a problem of silver-graphite dust which can cause a shorting problem in the connector. With the construction of FIG. 5 the chance of such a problem existing is substantially eliminated with the use of these filler beads 132, 134, 138. The filling of this space between inner and outer conductors assures that dust will not accumulate between the inner and outer conductors. The beads 132 and 134 and also the matching bead 138 may be constructed of a filled Teflon material.

In the embodiment of FIG. 5, the wave washer 146 may be pinned, such as to the housing 112 so that the washer does not rotate relative to the housing 112. In this way, the rotation between the wave washer is limited to rotation between the washer and the contact 148. FIG. 5 illustrates the pinning at 155.

FIG. 6 shows still a further embodiment of the present invention similar to the one depicted in FIG. 1. Because of this similarity in overall construction, only a portion of the overall connector is depicted in FIG. 6. The use of an extra contact member in FIG. 6 may also be employed in the preferred embodiment of FIG. 5. In FIG. 6 the parts of the connector that are substantially the same as depicted in FIG. 1, are identified by like reference characters. The additional members that are employed in FIG. 6 include washer 49 and contact member 57.

FIG. 6 shows the silver-graphite contact 48 and 56 which may be supported in the same manner as depicted in FIG. 1. The contact 56 is associated with the inner conductor including center conductor 25, while the contact 48 is associated with the outer conductor or housing 10. The other housing 12 supports the abode washer 52 in member 50, and the wave washer 46 received in a recess of the housing. The housing also has extended walls for supporting the center contact member 57 and the outer contact washer 49. Members 57 and 49 may both be constructed of a coin silver.

In the embodiment of FIG. 6 the additional members 49 and 57 enable rotation, for example, between washer member 49 and contact 48, rather than between the wave washer 46 and contact 48. There may be some slight rotation between, for example, the wave washer 46 and the housing end 13 in which it is supported. However, any rotation would be slight. The washer contact 49 may be pinned to the wave washer 46. A similar pinning can occur between the member 57 and the bowed washer 52. Also, the wave washer or the bowed washer could be pinned or welded directly to the conductors.

The additional members 49 and 57 depicted in FIG. 6 are preferably constructed of a hard, wear-resistant material such as coin silver. Another possible material is tungsten. Also, these members could be constructed of a berylium copper substrate that is plated. In this case the plating would have to be substantially thick enough so that it would not wear through. If the members 49 and 57 are constructed of a berylium copper with a hard material plating on the outside, then the other members such as the wave washer 46 and the bowed washer 52 need only be constructed of a resilient material and not a material having good wear qualities. For example, in that instance, then the wave washer could be constructed of a berylium copper without plating.

Having described a limited number of embodiments of this invention, it should now become apparent to those skilled in the art that numerous other embodiments will be contamplated as falling within the scope of this invention. For example, in FIG. 1, the silver-graphite contacts are supported in housing 10. However, these contacts could also be supported in housing 12 with the springs being supported in housing 10. Furthermore, the contacts 48 and 56 may be of another material than silver-graphite.

What is claimed is:

1. A rotary coaxial electrical connector associated with inner and outer coaxial conductors and comprising:

means defining a first member having a pair of conductive contacts supported thereby and associated respectively with said inner and outer conductors, means defining a second member having a pair of conductive means supported thereby and associated respectively with said inner and outer conductors, means intercoupling the first and second members in axial position but permitting relative rotation therebetween, and conductive and resilient spring means including inner and outer contact springs positioned respectively intermediate the conductive contacts and conductive means making electrical contact therebetween, each contact spring including a bowed surface member for contacting the associated conductive contact, said spring means being constructed of a relatively hard, wear resistant conductive metal substrate covered with a highly electrically conductive, less wear-resistant metal layer, whereby said spring means has, after a period of wear-in, a segment of the metal layer worn away to provide direct contact at said segment between the metal substrate and the conductive contact, providing, however, about the segment direct contact between the metal layer and the conductive contact thus providing a low noise contact, said contact springs both being supported between the conductive contacts and conductive means in a free floating position and secured substantially only by the spring compressing forces imposed via said conductive contacts and conductive means.

2. A connector as set forth in claim 1 wherein said spring means includes a bowed spring and wave spring.

3. A connector as set forth in claim 1 wherein the conductive contact has a flat surface and comprises silver-graphite.

4. A connector as set forth in claim 1 wherein said conductive contact has a substantially flat surface with contact with the spring means being only over a segment of the flat surface.

5. A connector as set forth in claim 1 including dielectric filler means between inner and outer conductors of the connector.

6. A connector as set forth in claim 1 wherein the spring means is a coil silver.

7. A connector as set forth in claim 1 wherein said less wear-resistant metal is from the noble family.

8. A connector as set forth in claim 7 wherein said plated layer comprises a silver plating.

9. A connector as set forth in claim 8 including another layer over the silver plating which is a tarnish resisting layer.

10. A connector as set forth in claim 9 wherein the tarnish resisting layer comprises rhodium or gold.

11. A connector as set forth in claim 7 wherein said substrate is a conductive metal that is relatively hard and from which a spring can be made.

12. A connector as set forth in claim 11 wherein said substrate comprises a sheet of berylium-copper.

13. A connector as set forth in claim 1, wherein said spring means is constructed of a silver alloy.

14. A connector as set forth in claim 13 wherein said silver alloy is an alloy of silver and copper.

15. A connector as set forth in claim 1, said spring means including a wave spring associated with the outer conductor and a bowed spring associated with the inner conductor.

16. A connector as set forth in claim 15 including additional contact members, one disposed between the bowed spring and its associated contact means and another disposed between the wave spring and its associated contact means.

17. A connector as set forth in claim 1 wherein said conductive contact has a substantially flat surface in connect with the contact spring.

18. A connector as set forth in claim 17 wherein only a single bowed contact spring is disposed between each conductive contact and conductive means.

19. A rotary coaxial electrical connector associated with inner and outer coaxial conductors and comprising;

means defining a first member having a pair of conductive contacts supported thereby and associated respectively with said inner and outer conductors, means defining a second member having a pair of conductive means supported thereby and associated respectively with said inner and outer conductors, means intercoupling the first and second members in axial position but permitting relative rotation therebetween, and conductive and resilient spring means including inner and outer contact springs positioned respectively intermediate the conductive contacts and conductive means making electrical contact therebetween, each contact spring including a bowed surface member for contacting the associated conductive contact, said spring means being constructed of a relatively hard, wear resistant conductive metal substrate covered with a highly electrically conductive, less wear-resistant metal layer, said contact springs both being supported between the conductive contacts and conductive means in a free floating position and secured substantially only by the spring compressing forces imposed via said conductive contacts and conductive means.

20. A rotary coaxial electrical connector as set forth in claim 9 wherein said spring means has, after a period of wherein, a segment of the metal layer worn away by direct contact at said segment between the metal substrate and the conductive contact providing, however, about the segment direct contact between the metal layer and the conductive contact, thus providing a low noise contact.

21. A rotary electrical contact apparatus associated with first and second concentric conductors and comprising:

means defining a first member having a pair of conductive contacts supported thereby and associated respectively with said first and second conductors, means defining a second member having a pair of conductive means supported thereby and associated respectively with said first and second conductors, means intercoupling the first and second members in axial position but permitting relative rotation therebetween, and conductive and resilient spring means including inner and outer contact springs positioned respectively intermediate the conductive contacts and conductive means making electrical contact therebetween, each contact spring including a bowed surface member for contacting the associated conductive contact, said spring means being constructed of a relatively hard, wear resistant conductive metal, substrate with a highly electrically conductive, less wear resistant metal, said contact springs both being supported between the conductive contact and conductive means in a free floating position and secured substantially only by the spring compressing forces imposed via said conductive contact and conductive means.

22. A rotary electrical contact apparatus as set forth in claim 21 wherein said spring means has, after a period of wear-in, a segment of the metal layer worn away to provide direct contact at said segment between the metal substrate and the conductive contact, providing, however, about the segment direct contact between the metal layer and the conductive contact thus providing a low noise contact.

* * * * *